US012146290B2

(12) United States Patent
Wada et al.

(10) Patent No.: US 12,146,290 B2
(45) Date of Patent: Nov. 19, 2024

(54) CONSTRUCTION MACHINE BOOM MOUNT DEVICE

(71) Applicant: KOBELCO CONSTRUCTION MACHINERY CO., LTD., Hiroshima (JP)

(72) Inventors: Ichiro Wada, Hiroshima (JP); Yukio Miyano, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 620 days.

(21) Appl. No.: 17/428,363

(22) PCT Filed: Dec. 24, 2019

(86) PCT No.: PCT/JP2019/050520
§ 371 (c)(1),
(2) Date: Aug. 4, 2021

(87) PCT Pub. No.: WO2020/188935
PCT Pub. Date: Sep. 24, 2020

(65) Prior Publication Data

US 2022/0112680 A1 Apr. 14, 2022

(30) Foreign Application Priority Data

Mar. 15, 2019 (JP) ..... 2019-049110

(51) Int. Cl.
*E02F 3/38* (2006.01)
*E02F 9/00* (2006.01)
*E02F 9/08* (2006.01)

(52) U.S. Cl.
CPC ..... *E02F 3/382* (2013.01); *E02F 9/006* (2013.01); *E02F 9/0808* (2013.01)

(58) Field of Classification Search
CPC ..... E02F 9/0808; E02F 9/006; E02F 3/382
See application file for complete search history.

(56) References Cited

FOREIGN PATENT DOCUMENTS

| | | | |
|---|---|---|---|
| JP | 6-300033 | A | 10/1994 |
| JP | 2008-202232 | A | 9/2008 |
| JP | 2010-59693 | A | 3/2010 |

(Continued)

OTHER PUBLICATIONS

International Search Report issued Feb. 4, 2020 in PCT/JP2019/050520 filed Dec. 24, 2019, 2 pages.

(Continued)

*Primary Examiner* — Ronald P Jarrett
(74) *Attorney, Agent, or Firm* — Oblon, McClelland, Maier & Neustadt, L.L.P.

(57) ABSTRACT

A boom mount device of a construction machine can easily align a boom with an upper frame of the construction machine when mounting the boom on the upper frame. The upper frame includes a center section including one pair of left-and-right vertical plates. The vertical plates include outside surfaces facing outside and guide parts disposed on the outside surfaces and guide holes are formed. An adapter that pivotably connects a base end of the boom and a base end of a boom cylinder is mounted on the base end side of the boom. The adapter includes one pair of left-and-right guide pins. When the boom is mounted on the upper frame, the one pair of left-and-right guide pins is inserted into the guide holes of the one pair of left-and-right guide parts.

6 Claims, 12 Drawing Sheets

(56) References Cited

FOREIGN PATENT DOCUMENTS

| | | | |
|---|---|---|---|
| JP | 2010-163823 | A | 7/2010 |
| JP | 4713516 | B2 | 6/2011 |
| JP | 2011-236593 | A | 11/2011 |

OTHER PUBLICATIONS

Extended European Search Report issued Feb. 9, 2022 in European Patent Application No. 19919719.5, 7 pages.

CONSTRUCTION MACHINE BOOM MOUNT DEVICE

TECHNICAL FIELD

The present invention relates to a boom mount device for mounting a boom on an upper frame of a construction machine.

BACKGROUND ART

Conventionally, a technique for mounting a work device (boom and the like) on an upper slewing body of a construction machine has been known. For example, Patent Literature 1 discloses, in a configuration in which an intermediate coupling body (adapter) is interposed between a vertical plate of a vehicle body frame and a work device, a technique for accurately positioning the intermediate coupling body.

Specifically, in the technique described in Patent Literature 1, a slewing frame of the upper slewing body includes left-and-right vertical plates, and the work device including the boom is mounted on the left-and-right vertical plates of the slewing frame via the intermediate coupling body. When the intermediate coupling body is lowered from above toward the left-and-right vertical plates, downward protrusion parts of left-and-right coupling body side guides provided on the intermediate coupling body move downward along vertical guide grooves of the left-and-right vertical plate side guides due to the weight of the intermediate coupling body, and then move diagonally downward and forward. This causes forward protrusion parts of the left-and-right coupling body side guides to be automatically engaged with front engagement grooves of the left-and-right vertical plate side guides.

CITATION LIST

Patent Literature

Patent Literature 1: Japanese Patent No. 4713516

However, the technique disclosed in Patent Literature 1 has a problem that, since the left-and-right vertical plate side guides are formed inside the left-and-right vertical plates, it is difficult for an operator to visually recognize relative positional relationship thereof from the side of the construction machine, and that it is difficult to align the intermediate coupling body with the left-and-right vertical plates.

SUMMARY OF INVENTION

An object of the present invention is to provide a boom mount device of a construction machine that can easily align a boom with an upper frame when mounting the boom on the upper frame of the construction machine.

The present invention provides a boom mount device for mounting a boom on an upper frame in a construction machine including the upper frame, the boom supported by the upper frame to allow rising and falling, and a boom cylinder that expands and contracts to cause the boom to rise and fall. The boom mount device includes: a center section provided on the upper frame and including a bottom plate and one pair of left-and-right vertical plates erected on the bottom plate; and an adapter that pivotably connects each of the boom and the boom cylinder to the center section. The adapter includes: an adapter body that pivotably supports a base end of the boom and a base end of the boom cylinder around rotation central axes each extending in a left-and-right direction; and one pair of left-and-right guide pins each extending downward from the adapter body, the one pair of left-and-right vertical plates each includes: an outside surface facing outside of the left-and-right direction; and a guide part disposed on the outside surface and including an upper surface part, a guide hole capable of receiving each of the guide pins along a downward direction when the boom is attached to the upper frame being open on the upper surface part of the guide part.

DESCRIPTION OF EMBODIMENT

Figure 1:
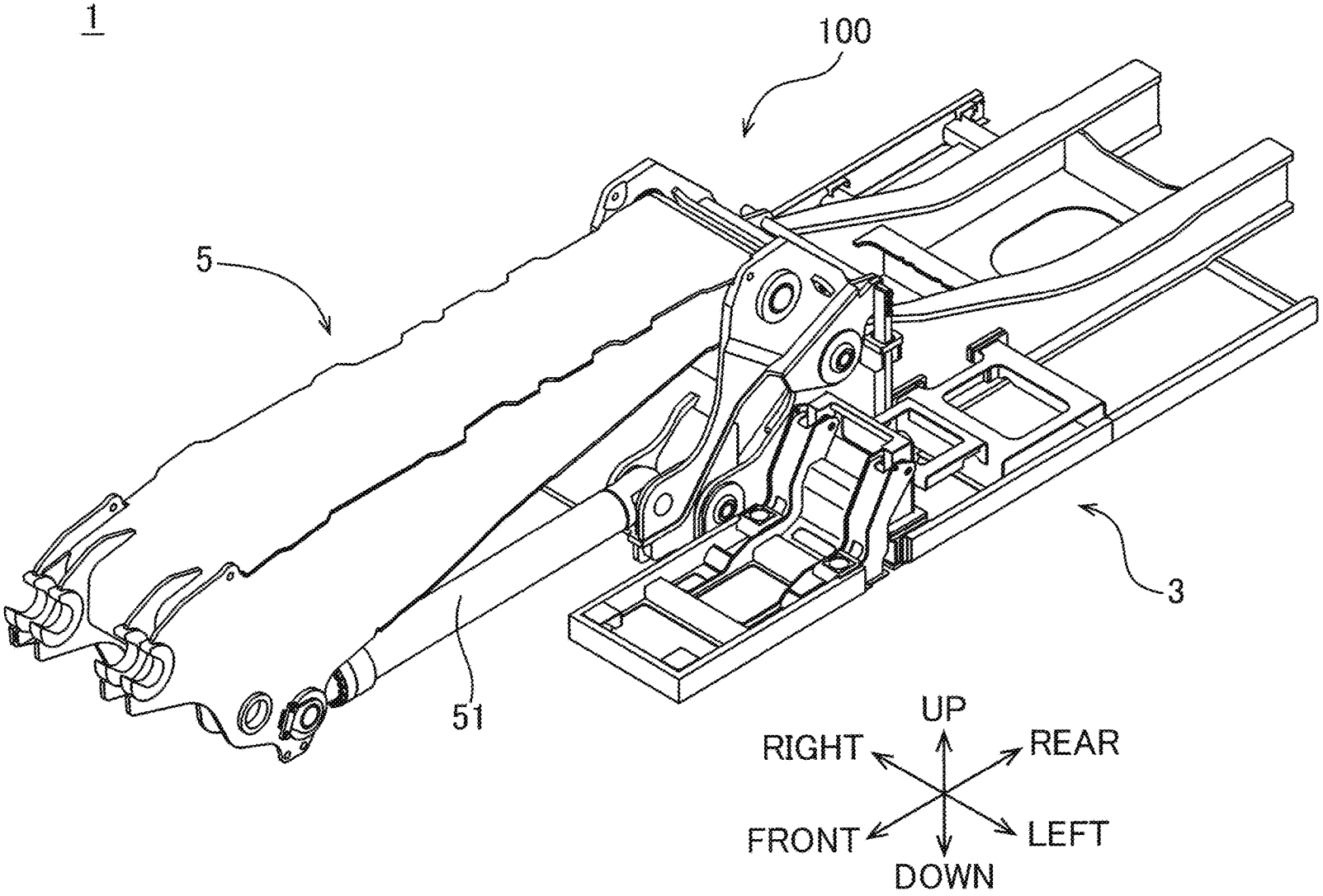
FIG. 1 is a perspective view showing one part of a construction machine according to one embodiment of the present invention.

A boom mount device 100 of a construction machine according to one embodiment of the present invention will be described with reference to FIGS. 1 to 12. Hereinafter, a hydraulic excavator 1 shown in FIG. 1 will be illustrated as a construction machine according to the present invention. FIG. 1 is a perspective view showing one part of the hydraulic excavator 1 according to the present embodiment.

As shown in FIG. 1, the hydraulic excavator 1 includes a lower travelling body (not shown), an upper slewing body 3 rotatably carried on the lower travelling body, and a boom 5 attached to the upper slewing body 3 (one component constituting a work attachment).

Figure 2:
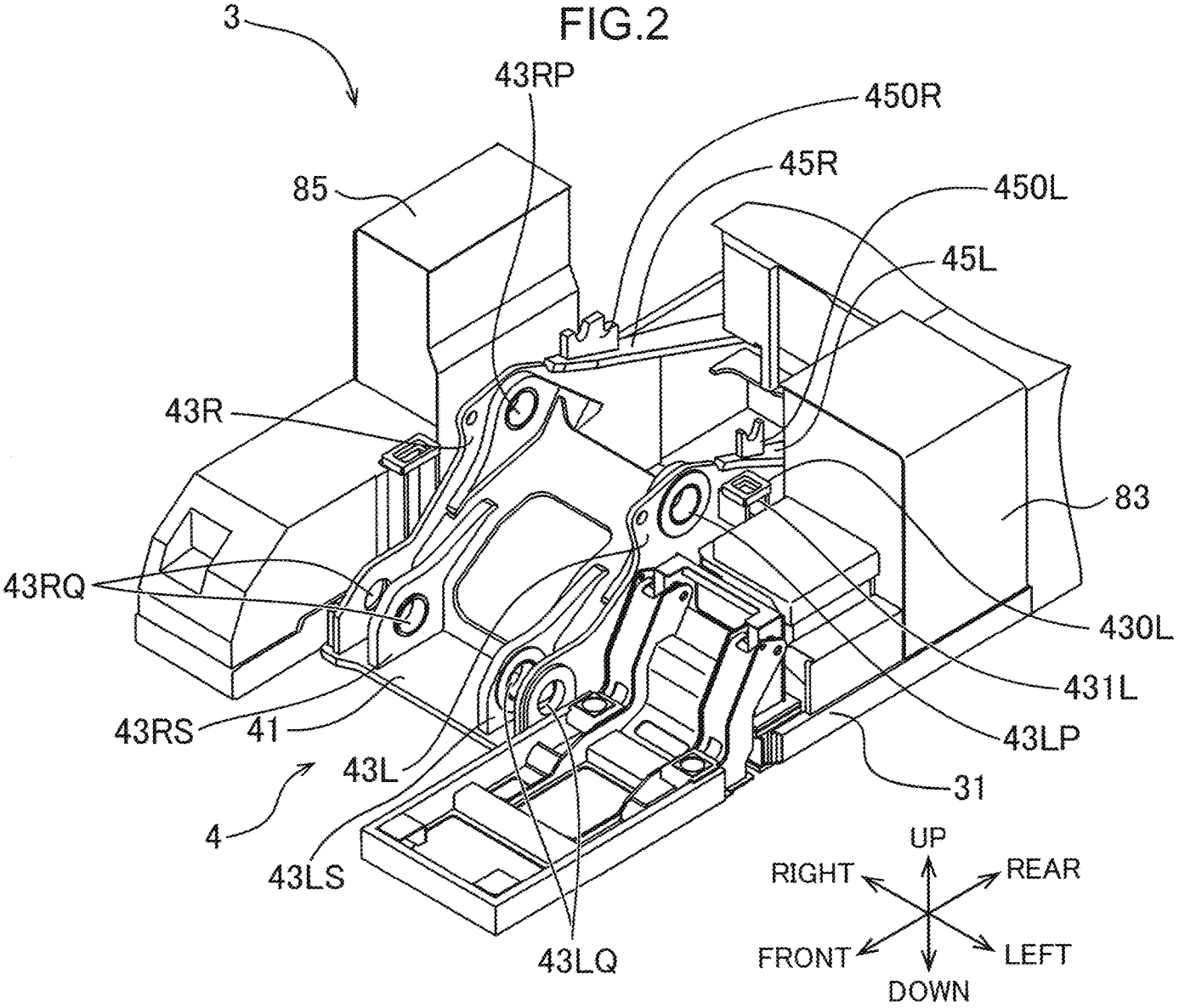
FIG. 2 is a perspective view showing an upper frame of an upper slewing body of the construction machine according to one embodiment of the present invention.
Figure 3:
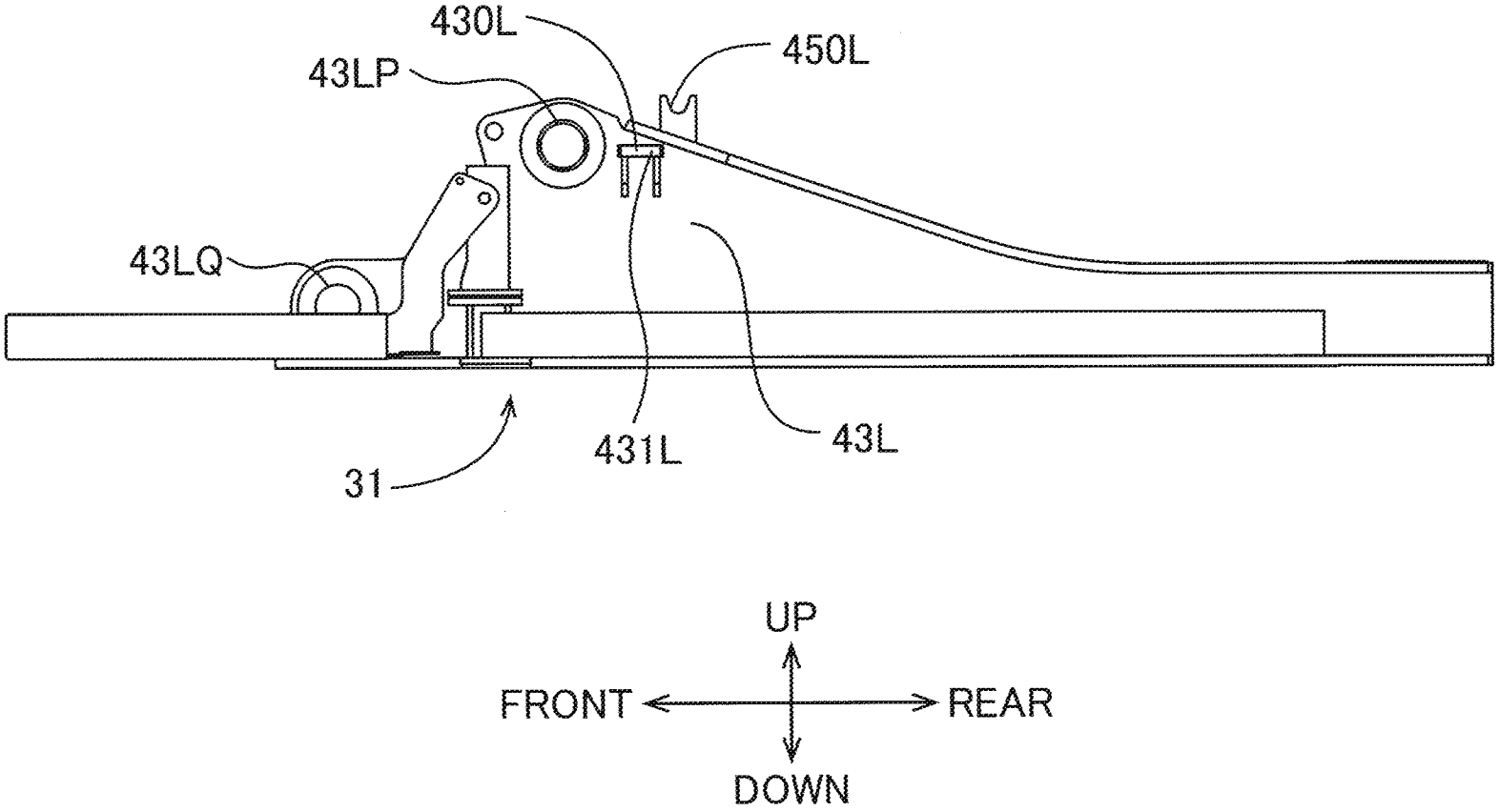
FIG. 3 is a side view of the upper frame of the construction machine according to one embodiment of the present invention when viewed from a left side of the machine.
Figure 4:
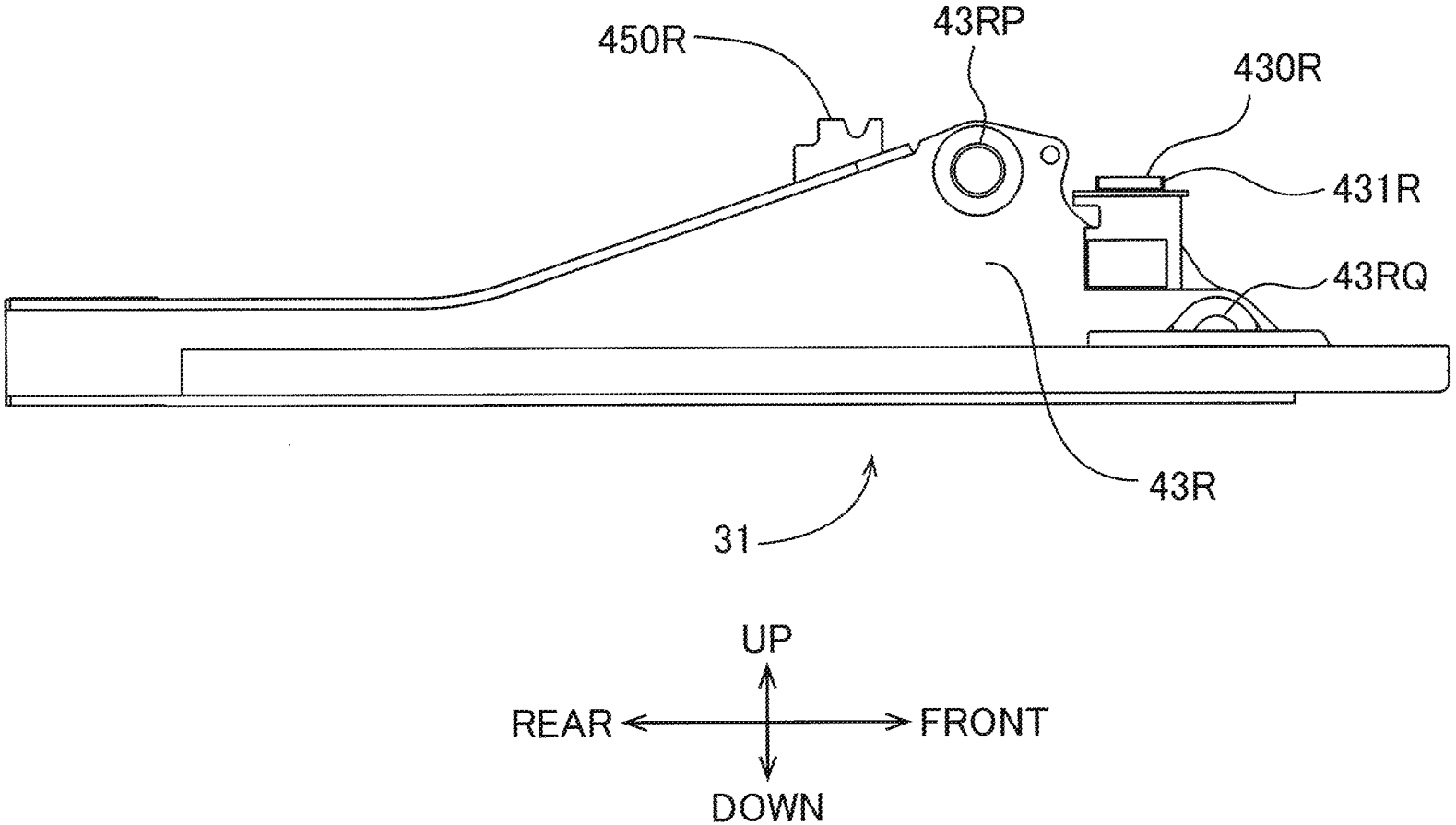
FIG. 4 is a side view of the upper frame of the construction machine according to one embodiment of the present invention when viewed from a right side of the machine.

FIG. 2 is a perspective view showing an upper frame 31 of the upper slewing body 3 of the hydraulic excavator 1 according to the present embodiment. FIG. 3 is a side view of the upper frame 31 of the hydraulic excavator 1 according to the present embodiment when viewed from a left side of the machine. FIG. 4 is a side view of the upper frame 31 of the hydraulic excavator 1 according to the present embodiment when viewed from a right side of the machine. As shown in FIG. 2, the upper slewing body 3 includes the upper frame 31 that can carry various facilities and devices such as a cabin (driver's cab). The upper frame 31 includes a center section 4 located in a central portion of a vehicle width direction (left-and-right direction) thereof. The boom 5 is supported by the upper frame 31 to allow rising and falling.

The center section 4 includes a bottom plate 41, one pair of left-and-right vertical plates 43L and 43R erected on the bottom plate 41, one pair of left-and-right inside vertical plates 43LS and 43RS (FIG. 2) disposed therewithin, and back plates 45L and 45R provided at upper edges of the vertical plates 43L and 43R, respectively. Connection pin holes 43LQ and 43RQ opened along the left-and-right direction are respectively formed at front ends of the one pair of left-and-right vertical plates 43L and 43R and front ends of the one pair of left-and-right inside vertical plates 43LS and 43RS. Connection pin holes 43LP and 43RP are formed on top of the one pair of left-and-right vertical plates 43L and 43R, respectively. Adapter connection pins (not shown) for connecting and fixing the adapter 7 described later to the center section 4 of the upper frame 31 are inserted into these connection pin holes.

As shown in FIGS. 2 and 3, the center section 4 includes a guide part 431L disposed on a surface (outside surface) facing outside (left side) of the left side vertical plate 43L and including an upper surface part. A guide hole 430L having an up-and-down direction as an insertion direction is formed on the upper surface part of the guide part 431L. The guide hole 430L has a size that allows the guide pin 75L described later (see FIG. 5) to be inserted.

The center section 4 includes a bracket 450L (positioning part) disposed on an upper surface of the left side back plate 45L and including a recess opened upward. The recess of the bracket 450L has an R shape that allows surface contact with one part of a body of the positioning pin 79 described later (see FIG. 8). Therefore, the bracket 450L includes one pair of front-and-rear inner wall surfaces disposed to face each other in a front-and-rear direction so as to define the recess, and a lower surface part connecting the one pair of inner wall surfaces. The R shape is applied to the lower surface part.

As shown in FIG. 4, the center section 4 includes a guide part 431R disposed on a surface facing outside (right side) of the right side vertical plate 43R and including an upper surface part. A guide hole 430R having an up-and-down direction as an insertion direction is formed on the upper surface part of the guide part 431R. The guide hole 430R has a size that allows the guide pin 75R described later (see FIG. 7) to be inserted.

As shown in FIGS. 2 and 4, the center section 4 includes a bracket 450R (positioning part) disposed on an upper surface of the right side back plate 45R and including a recess opened upward. The recess of the bracket 450R has an R shape that allows surface contact with one part of the body of the positioning pin 79 described later (see FIG. 8). Therefore, the bracket 450R includes one pair of front-and-rear inner wall surfaces disposed to face each other in the front-and-rear direction so as to define the recess, and a lower surface part connecting the one pair of inner wall surfaces. The R shape is applied to the lower surface part.

Figure 5:
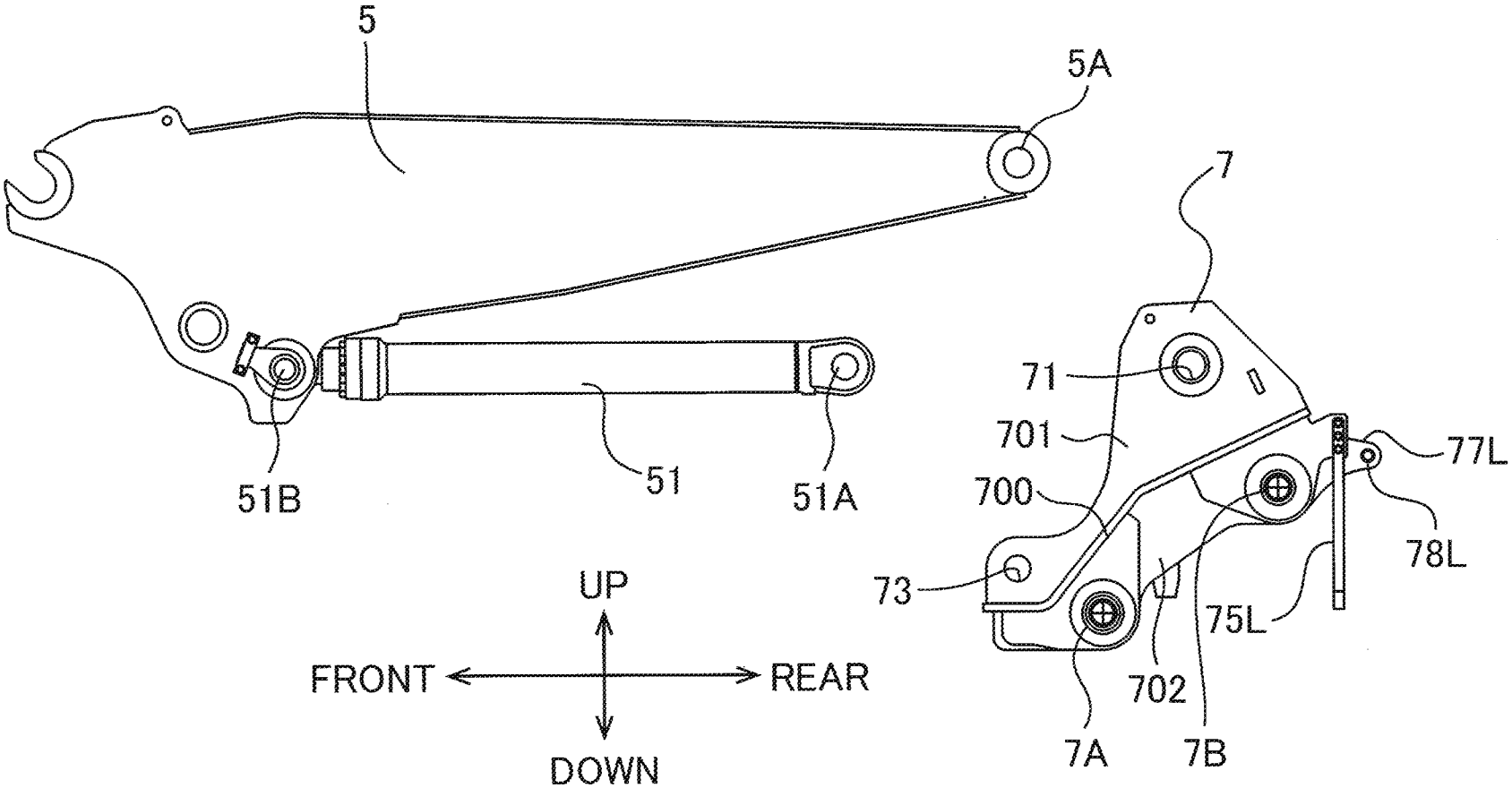
FIG. 5 is a side view showing a state where a boom and an adapter of the construction machine according to one embodiment of the present invention are disassembled.

FIG. 5 is a side view showing a state where the boom 5 and the adapter 7 of the hydraulic excavator 1 according to the present embodiment are disassembled. As shown in FIG. 5, the hydraulic excavator 1 further includes a boom cylinder 51 that is attached to the boom 5 and can be expanded and contracted to cause the boom 5 to rise and fall.

The adapter 7 (also referred to as a subframe or the like) for integrally disassembling and assembling the boom 5 and the boom cylinder 51 is mounted on a base end side of the boom 5. The adapter 7 pivotably connects the boom 5 and the boom cylinder 51 to the center section 4. An insertion hole 71 for a connection pin (not shown) pivotably connecting the base end of the boom 5 and an insertion hole 73 for a connection pin (not shown) pivotably connecting the base end of the boom cylinder 51 are formed in the adapter 7. Note that the center section 4 and the adapter 7 constitute the boom mount device 100 of the present invention. The boom mount device 100 is a structure for mounting the boom 5 on the upper frame 31 in the hydraulic excavator 1.

Figure 6:
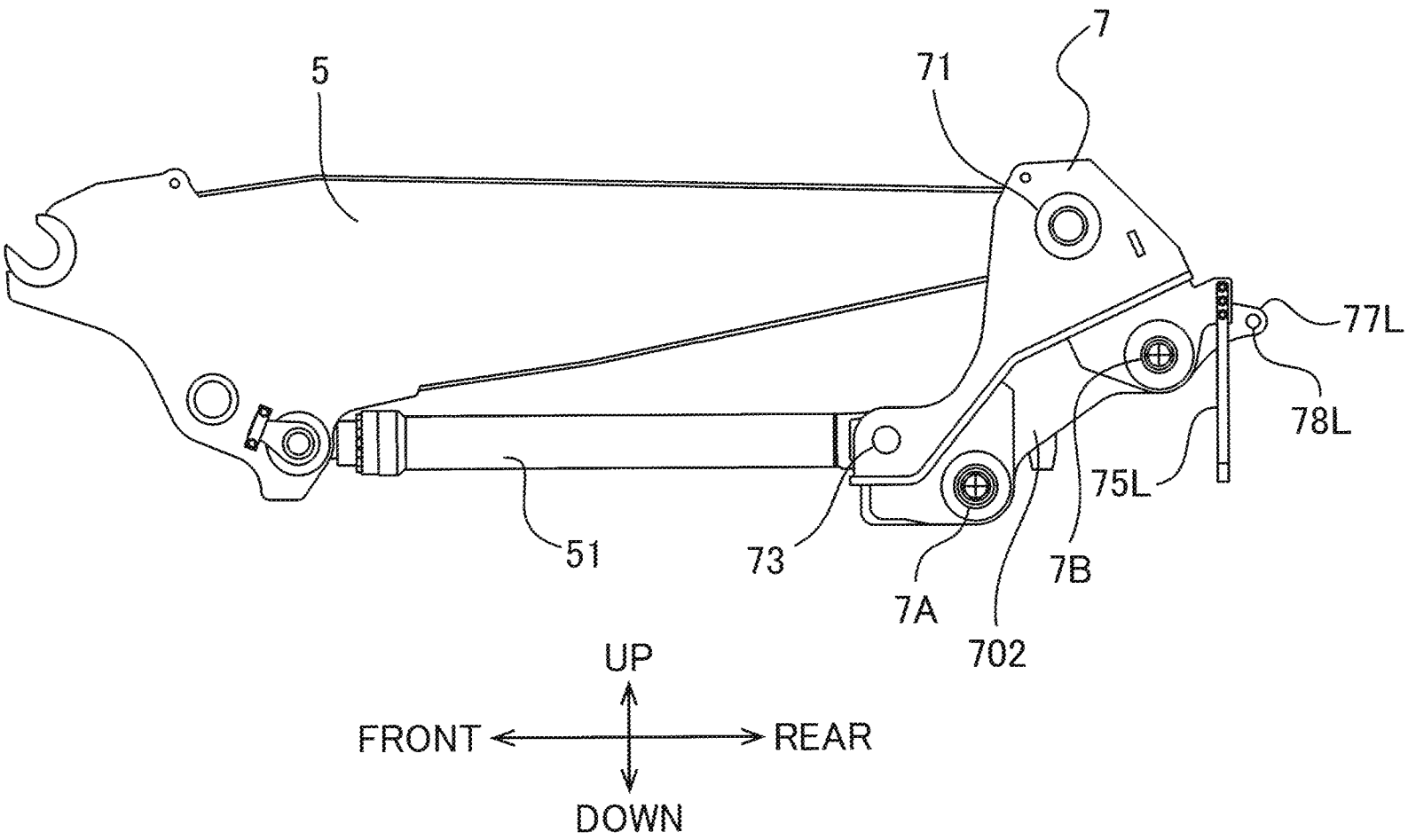
FIG. 6 is a side view of a state where the adapter is attached to the boom of the construction machine according to one embodiment of the present invention when viewed from the left side of the machine.

FIG. 6 is a side view of the boom 5 in a state where the adapter 7 of the hydraulic excavator 1 according to the present embodiment is attached when viewed from the left side of the machine. As shown in FIG. 6, the base end of the boom 5 and the base end of the boom cylinder 51 are mounted on the adapter 7 pivotably around rotation central axes extending in the left-and-right direction, and the boom 5 and the boom cylinder 51 are held integrally by the adapter 7 and allows pivotably connection to the center section 4.

The adapter 7 includes an adapter body 700 and the one pair of left-and-right guide pins 75L and 75R each extending downward from the adapter body 700. The adapter body 700 pivotably supports the base end of the boom 5 and the base end of the boom cylinder 51 around rotation central axes each extending in the left-and-right direction. The adapter body 700 has a shape that rises rearward, and includes a left side plate and a right side plate disposed with a space in the left-and-right direction (one pair of left-and-right side plates). These left-and-right side plates each include an upper side plate 701 and a lower side plate 702. The insertion hole 71 for pivotably supporting a base end 5A of the boom 5 (FIG. 5) and the insertion hole 73 for pivotably supporting a base end 51A of the boom cylinder 51 (FIG. 5) are each formed in the upper side plate 701. Meanwhile, connection pin holes 7A and 7B for connecting the adapter 7 to the center section 4 are each formed in the lower side plate 702. The adapter connection pins for connecting and fixing the adapter 7 to the center section 4 of the upper frame 31 are inserted into these connection pin holes.

As shown in FIG. 5, the guide pin 75L, which is long in the up-and-down direction, is provided so as to extend downward on a surface (outside surface) facing outside (left side) of the left side plate (lower side plate 702) of the adapter body 700 of the adapter 7. The guide pin 75L is configured to have a thickness that can be inserted into and removed from the guide hole 430L described above (FIGS. 2 and 3).

Figure 7:
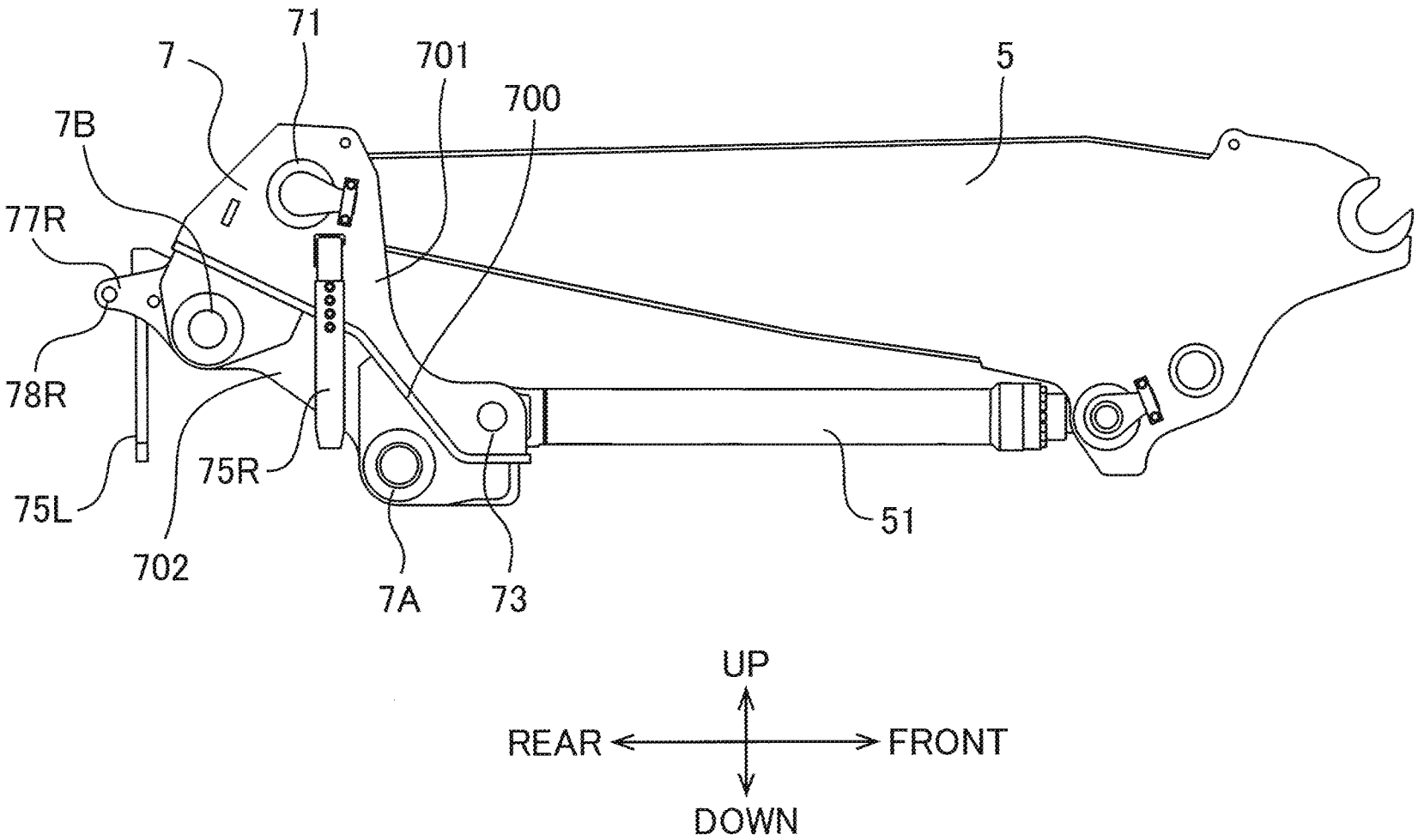
FIG. 7 is a side view of a state where the adapter is attached to the boom of the construction machine according to one embodiment of the present invention when viewed from the right side of the machine.

FIG. 7 is a side view of the boom 5 in a state where the adapter 7 of the hydraulic excavator 1 according to the present embodiment is attached when viewed from the right side of the machine. As shown in FIG. 7, the guide pin 75R, which is long in the up-and-down direction, is provided so as to extend downward on a surface (outside surface) facing outside (right side) of the right side plate (lower side plate 702) of the adapter body 700 of the adapter 7. The guide pin 75R is configured to have a thickness that can be inserted into and removed from the guide hole 430R described above (FIG. 4).

Figure 8:
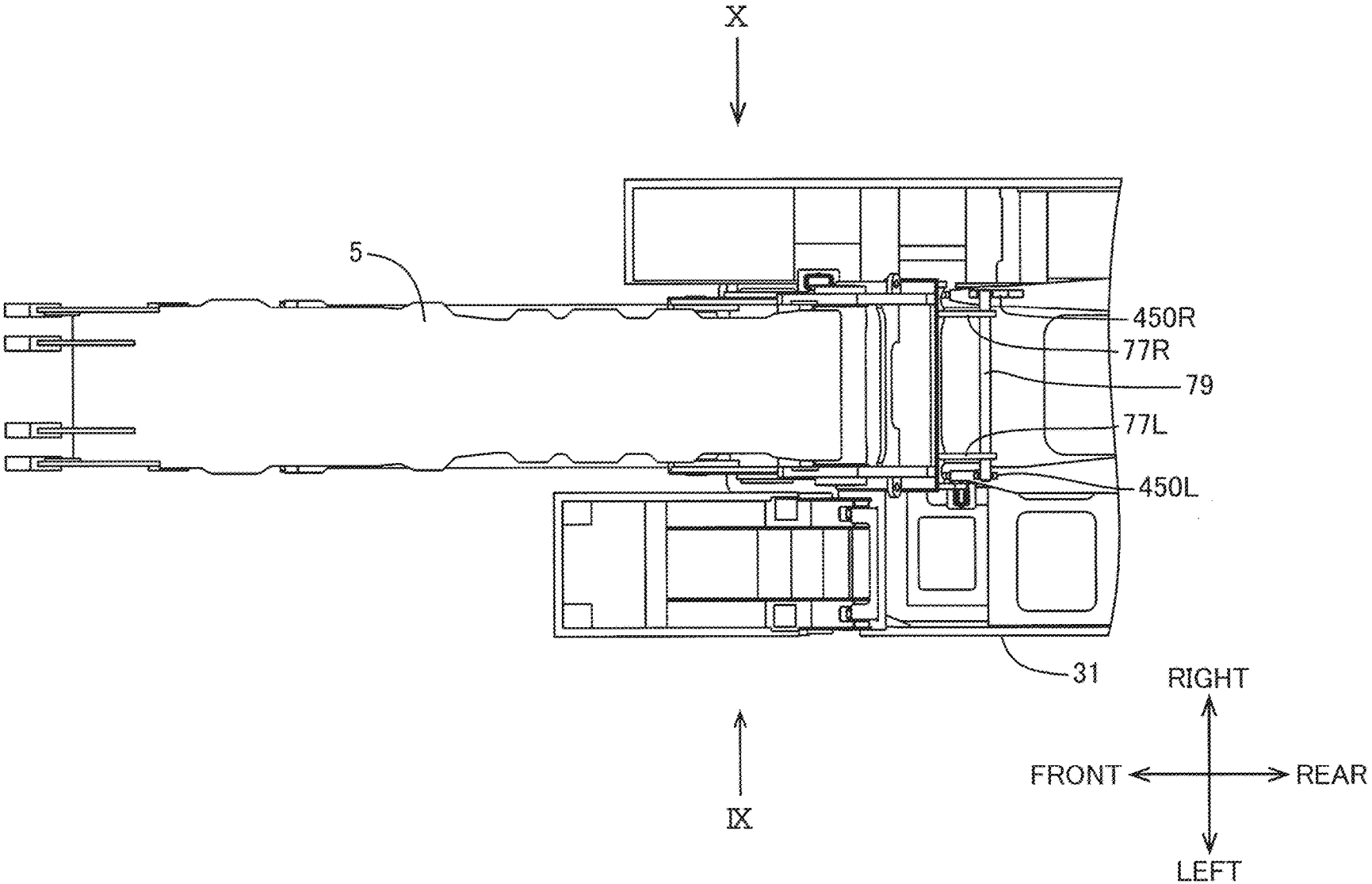
FIG. 8 is a plan view showing how the adapter of the construction machine is mounted on the upper frame according to one embodiment of the present invention.

FIG. 8 is a plan view showing how the adapter 7 of the hydraulic excavator 1 is mounted on the upper frame 31 according to the present embodiment. As shown in FIGS. 5 to 8, the adapter body 700 of the adapter 7 includes one pair of left-and-right rearward overhang parts 77L and 77R whose one part of the rear end side overhangs rearward of the machine, and the positioning pin 79. Pin holes 78L and 78R (positioning pin holes) penetrating the rearward overhang parts 77L and 77R along the left-and-right direction are formed (opened) in the rearward overhang parts 77L and 77R, respectively. The positioning pin 79 shown in FIG. 8 is inserted into and fixed to the pin holes 78L and 78R. Note that the one pair of left-and-right rearward overhang parts 77L and 77R each include an outside surface facing outside of the left-and-right direction (overhang part outside surface).

As shown in FIG. 8, the positioning pin 79 has a dimension larger than a space between the one pair of left-and-right rearward overhang parts 77L and 77R in the left-and-right direction, and is mounted on (fixed to) the one pair of left-and-right rearward overhang parts 77L and 77R while being inserted into the pin holes 78L and 78R such that left-and-right ends thereof protrude to the left-and-right outside from the pin holes 78L and 78R (outside surfaces of the one pair of left-and-right rearward overhang parts 77L and 77R), respectively. As will be described in detail later, when the adapter 7 is attached to the upper frame 31, out of the body of the positioning pin 79, parts protruding to the left-and-right outside from the pin holes 78L and 78R (both ends of the positioning pin 79) fit into the recesses of the brackets 450L and 450R as engagement pins, respectively.

When attaching the boom 5 (adapter 7) to the upper frame 31, first of all, the boom 5 is gradually lowered by using a crane or the like (not shown) such that the left-and-right guide pins 75L and 75R are inserted into the left-and-right guide holes 430L and 430R.

Figure 9:
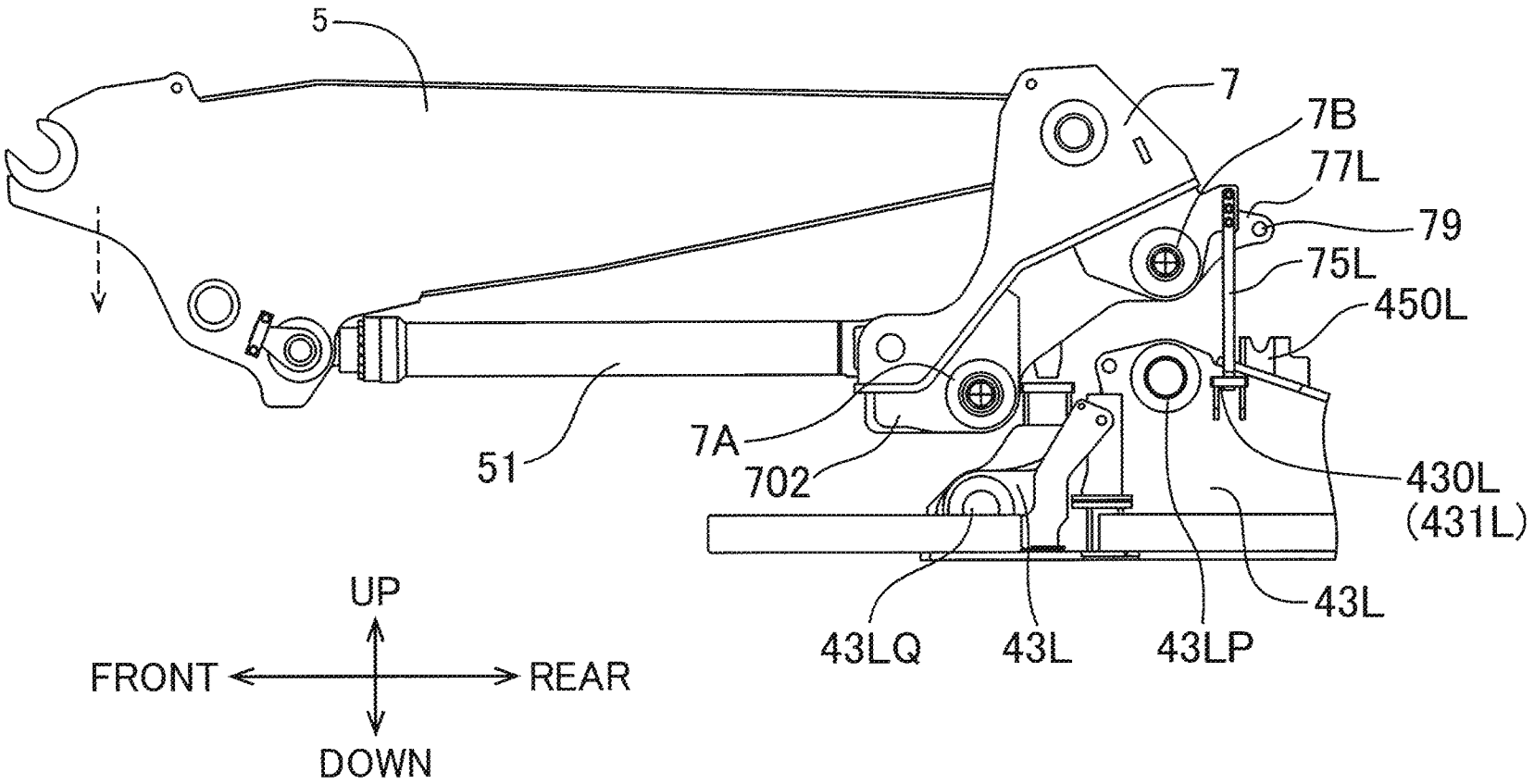
FIG. 9 is a side view of FIG. 8 viewed along an arrow IX.
Figure 10:
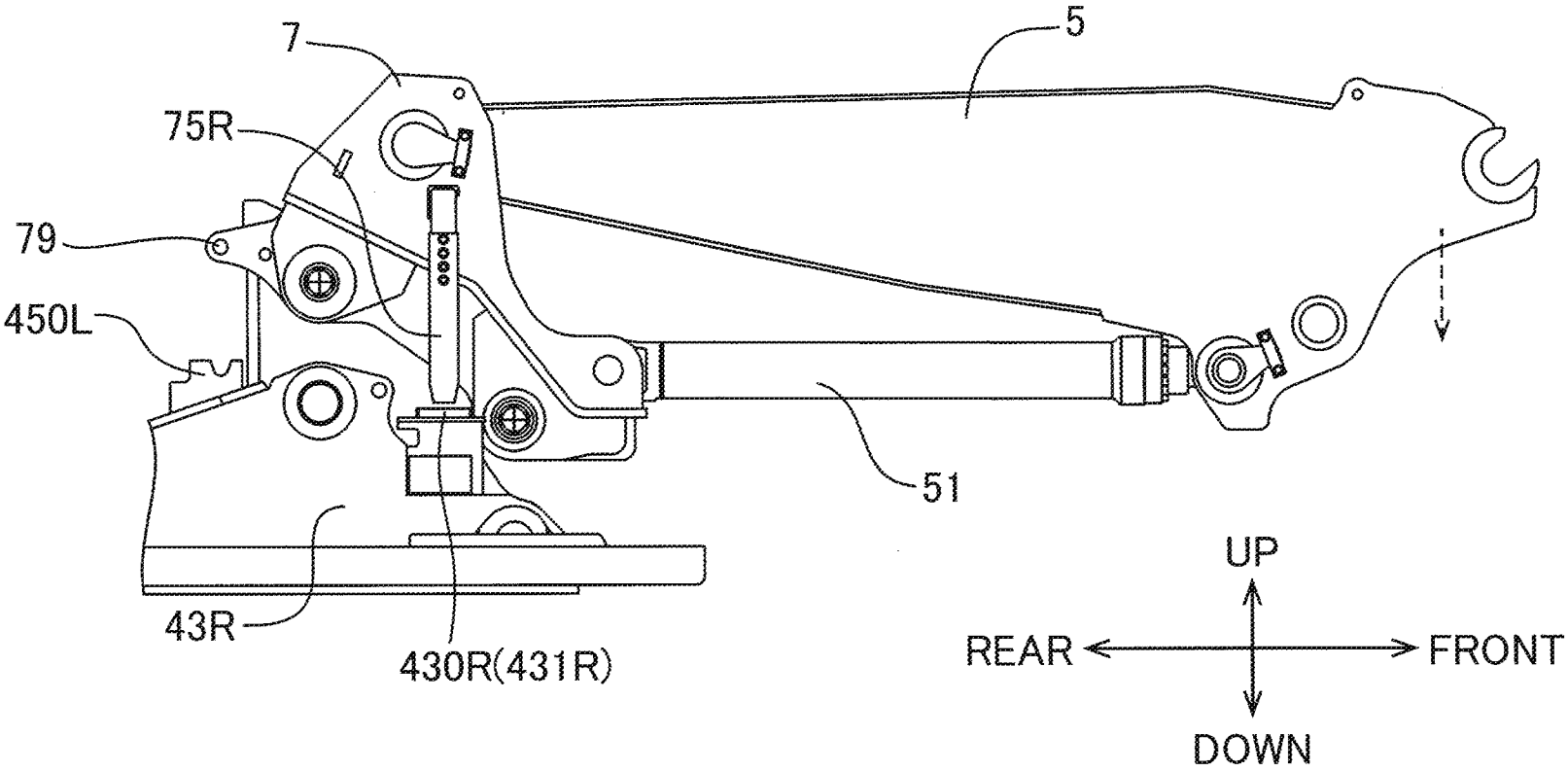
FIG. 10 is a side view of FIG. 8 viewed along an arrow X.

FIG. 9 is a side view of FIG. 8 viewed along an arrow IX. FIG. 10 is a side view of FIG. 8 viewed along an arrow X. The present embodiment has a configuration in which, although the left-and-right guide holes 430L and 430R are disposed at almost the same height, the left side guide pin 75L is longer (protruding downward more) than the right side guide pin 75R. Therefore, when the boom 5 is gradually lowered, as shown in FIGS. 9 and 10, the left side guide pin 75L is first inserted into the left side guide hole 430L, and when the boom 5 is further lowered, the opposite side (right side) guide pin 75R is inserted into the right side guide hole 430R.

When the left-and-right guide pins 75L and 75R are inserted into the left-and-right guide holes 430L and 430R, respectively, the rough position of the boom 5 (adapter 7) is determined. In more detail, the relative position of the adapter 7 with respect to the center section 4 is determined (constrained) such that the relative positions of the connection pin holes 43LQ and 43RQ formed in the center section 4 of the upper frame 31 and the one pair of left-and-right connection pin holes 7A formed in the adapter 7 in the front-and-rear direction and left-and-right direction agree with each other, and that the relative positions of the connection pin holes 43LP and 43RP formed in the center section 4 and the one pair of left-and-right connection pin holes 7B formed in the adapter 7 in the front-and-rear direction and left-and-right direction agree with each other. Thereafter, when the boom 5 is further lowered, the positioning pin 79 described above (see FIG. 8) finally fits into the recesses of the left-and-right brackets 450L and 450R. In detail, out of the body of the positioning pin 79, portions protruding to the left-and-right outside from the pin holes 78L and 78R (both ends, engagement pins) are in surface contact with and fit into the recesses of the brackets 450L and 450R, respectively. In this way, the one pair of left-and-right brackets 450L and 450R (positioning parts) receives both ends of the positioning pin 79 of the adapter 7 into the recesses from above, whereby the adapter 7 is prevented from at least moving downward and the final position of the boom 5 is determined. In more detail, the relative position of the adapter 7 with respect to the center section 4 is determined (constrained) such that the relative positions of the connection pin holes 43LQ and 43RQ formed in the center section 4 of the upper frame 31 and the one pair of left-and-right connection pin holes 7A formed in the adapter 7 in the front-and-rear direction, left-and-right direction, and up-and-down direction agree with each other, and that the relative positions of the connection pin holes 43LP and 43RP formed in the center section 4 and the one pair of left-and-right connection pin holes 7B formed in the adapter 7 in the front-and-rear direction, left-and-right direction, and up-and-down direction agree with each other. Then, when adapter connection pins (not shown) are inserted into the connection pin holes 43LQ and 43RQ and the one pair of left-and-right connection pin holes 7A and adapter connection pins (not shown) are inserted into the connection pin holes 43LP and 43RP and the one pair of left-and-right connection pin holes 7B, the adapter 7 is fixed to the upper frame 31. As a result, the boom 5 is pivotably supported by the upper frame 31.

When the boom 5 is removed from the upper frame 31, the boom 5 is gradually lifted by using a crane or the like (not shown). When the boom 5 is gradually lifted, there is a time point when the adapter 7 attached to the boom 5 separates from the upper frame 31. Note that the time point when the adapter 7 separates from the upper frame 31 refers to the time point when the left-and-right side plates of the adapter body 700 of the adapter 7 and the left-and-right vertical plates 43L and 43R constituting the center section 4 do not overlap each other in the machine width direction (left-and-right direction).

Figure 11:
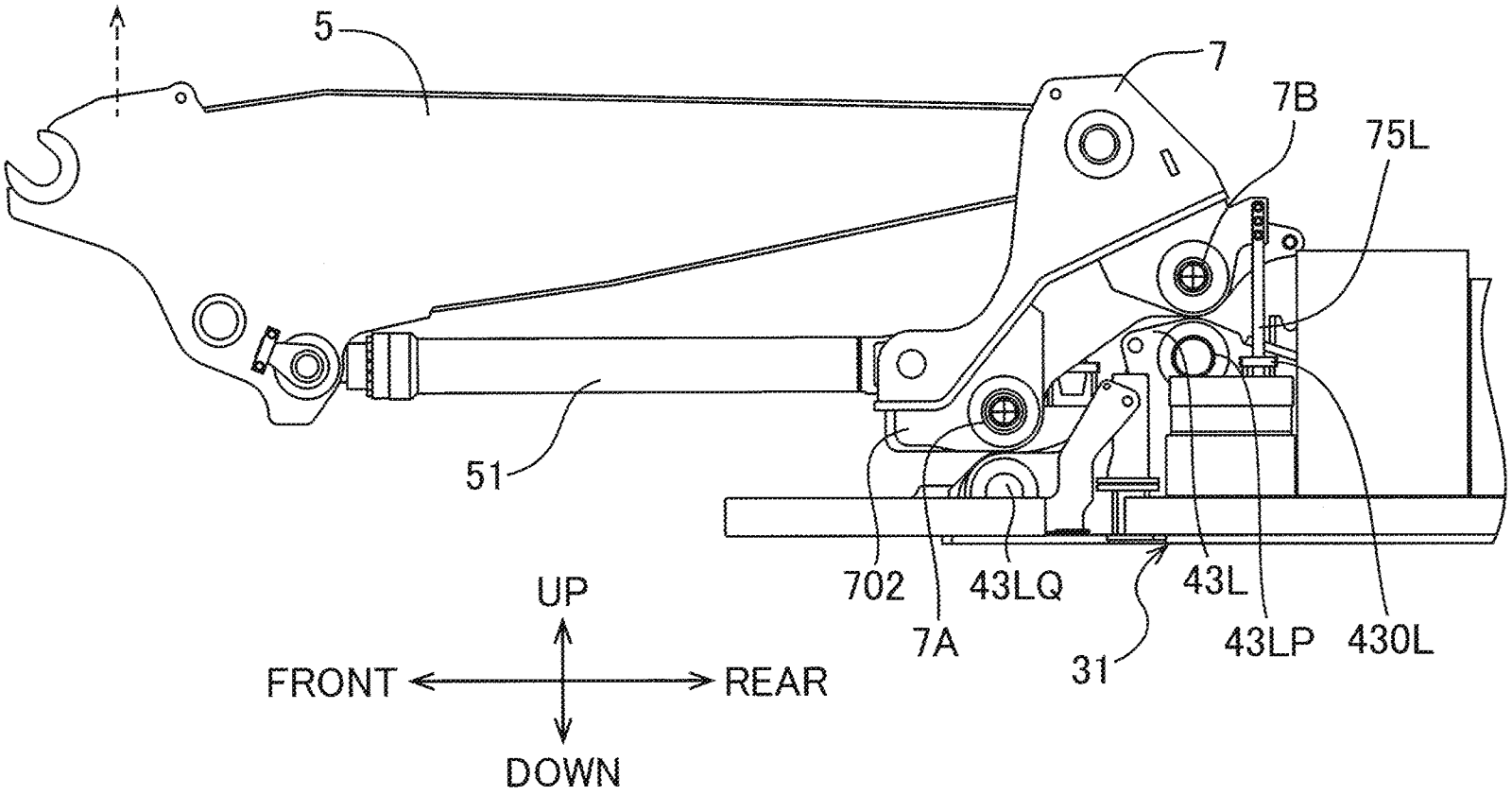
FIG. 11 is a side view of a state when the adapter of the construction machine separates from the upper frame according to one embodiment of the present invention when viewed from the left side of the machine.
Figure 12:
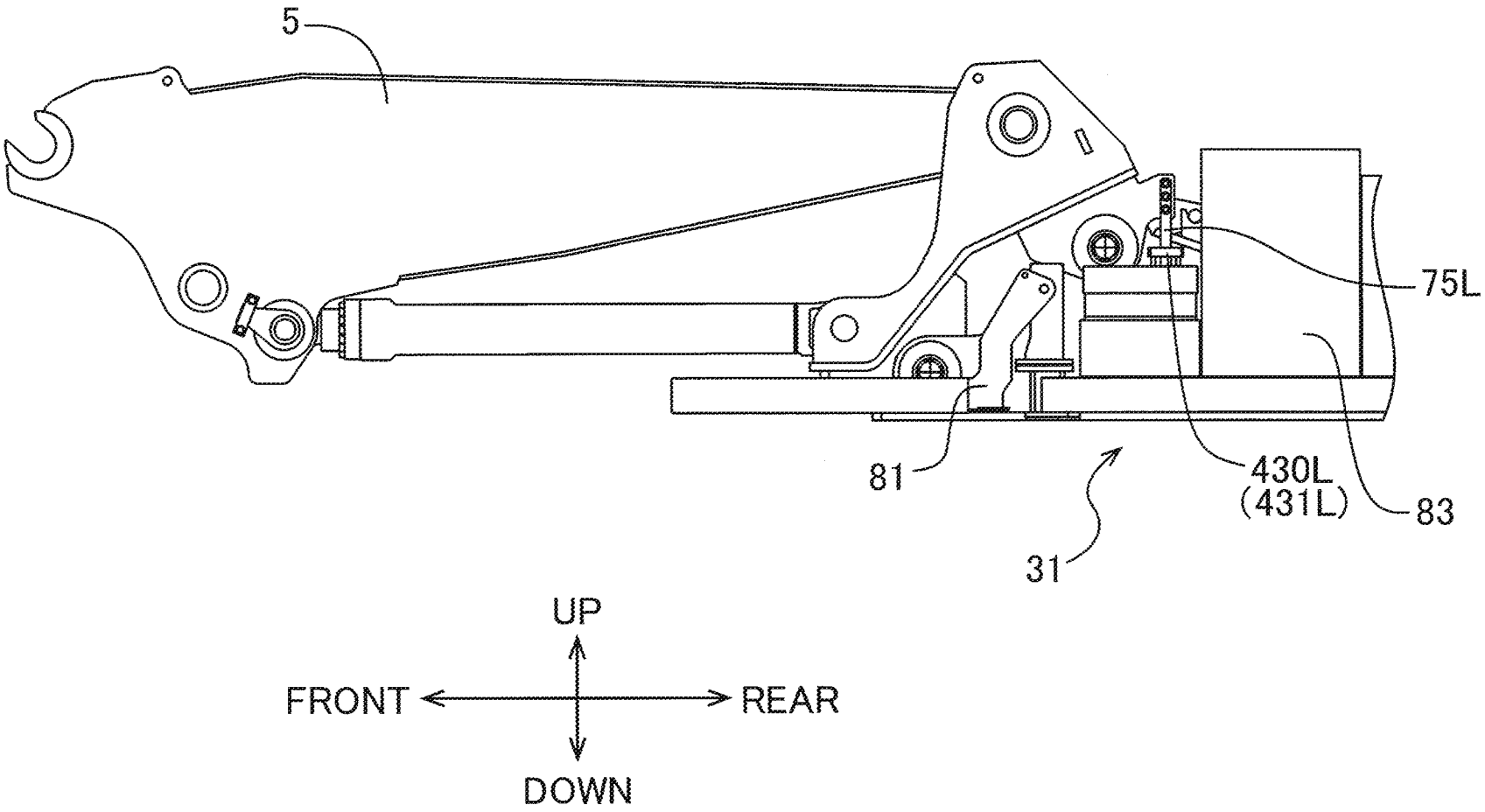
FIG. 12 is a side view of a state where the adapter of the construction machine is mounted on the upper frame according to one embodiment of the present invention when viewed from the left side of the machine.

FIG. 11 is a side view of a state when the adapter 7 of the hydraulic excavator 1 separates from the upper frame 31 according to the present embodiment when viewed from the left side of the machine. FIG. 12 is a side view of a state where the adapter 7 of the hydraulic excavator 1 is mounted on the upper frame 31 according to the present embodiment when viewed from the left side of the machine. In the present embodiment, as shown in FIG. 11, when the adapter 7 separates from the upper frame 31, the left side guide pin 75L remains inserted into the left side guide hole 430L. Although not shown, the opposite side (right side) guide pin 75R also remains inserted into the right side guide hole 430R. That is, in the configuration, when the adapter 7 separates from the upper frame 31, the left-and-right guide pins 75L and 75R have lengths to remain inserted into the left-and-right guide holes 430L and 430R. Note that the lengths of the one pair of left-and-right guide pins 75L and 75R may be set such that, in a case where the adapter 7 is detached from the upper frame 31, when the lower end of the adapter body 700 agrees with the upper end of the one pair of left-and-right vertical plates 43L and 43R of the center section 4 as viewed from the left-and-right direction, at least one of the one pair of left-and-right guide pins 75L and 75R is inserted into at least one of the guide holes 430L and 430R of the one pair of left-and-right vertical plates 43L and 43R.

As shown in FIG. 12, the left side guide part 431L is disposed at a position visually recognizable from the outside of the machine (left side) of the hydraulic excavator 1 in side view (when viewed from the left side). In detail, the left side guide part 431L is disposed between a tilt deck 81 on which a cabin (not shown) is installed and a hydraulic oil tank 83 in the front-and-rear direction. At this time, if an operator can visually recognize the guide part 431L from the left side, the insertion state of the guide pin 75L can be sufficiently confirmed, but if the guide hole 430L formed in the guide part 431L can be further visually recognized from the viewpoint of the operator, insertion work of the guide pin 75L can be performed more easily and reliably. Note that the same applies to the right side guide part 431R.

In the present embodiment, as shown in FIG. 2, a structure 85 on the upper frame 31 is disposed on the opposite side of the left-and-right direction of the guide part 431L. Therefore, the guide part 431R is disposed forward of the structure 85, and in the same manner as described above, the guide part 431R can be visually recognized from the right side of the hydraulic excavator 1. Note that the guide part 431L is disposed rearward of the connection pin hole 43LP (FIG. 3), and the guide part 431R is disposed frontward of the connection pin hole 43RP (FIG. 4). Note that the connection pin holes 43LP and 43RP are disposed on the same axis.

As described above, in the present embodiment, the guide hole 430L (see FIGS. 2 and 3) is formed in the guide part 431L disposed on the surface facing outside (left side) out of the vertical plate 43L, and the guide hole 430R (see FIG. 4) is formed in the guide part 431R disposed on the surface facing outside (right side) out of the vertical plate 43R. The guide pin 75L (see FIG. 5) is provided so as to extend downward on the surface facing outside (left side) out of the left side plate of the adapter body 700 of the adapter 7. The guide pin 75R (see FIG. 7) is provided so as to extend downward on the surface facing outside (right side) out of the right side plate of the adapter body 700 of the adapter 7. Therefore, when mounting the adapter 7 on the center section 4, the insertion situation of the left-and-right guide pins 75L and 75R and the left-and-right guide holes 430L and 430R can be visually recognized from the side of the machine. Therefore, when mounting the boom 5 (adapter 7) on the center section 4, it is possible to easily align the boom 5 and the center section 4. Note that the left-and-right guide pins 75L and 75R may protrude from the lower surface part of the adapter body 700 of the adapter 7 or the like.

In the present embodiment, when the left-and-right guide pins 75L and 75R are inserted into the left-and-right guide holes 430L and 430R, respectively, the rough position of the boom 5 (position in the front-and-rear direction and left-and-right direction) is determined. Then, when portions of the body of the positioning pin 79 protruding from the pin holes 78L and 78R to the left-and-right outside (engagement pins) fit into the recesses of the brackets 450L and 450R from above, respectively, the final position of the boom 5 (position in the front-and-rear direction, left-and-right direction, and up-and-down direction) is determined. That is, the present embodiment has a configuration in which the boom 5 is positioned in two stages in order. Therefore, it is possible to align the boom 5 more easily than in a configuration in which the boom is positioned in one step.

The present embodiment has a configuration in which, while the left-and-right guide holes 430L and 430R are disposed at substantially the same height, the left side guide pin 75L is longer and extends downward more than the right side guide pin 75R. Therefore, the relative positions of the one pair of left-and-right guide pins 75R and 75L and the guide holes 430R and 430L of the one pair of left-and-right guide parts are set such that, as shown in FIGS. 9 and 10, when the boom 5 is gradually lowered, the guide pin 75L is first inserted into the guide hole 430L, and when the boom 5 is further lowered, the opposite side guide pin 75R is inserted into the guide hole 430R. Therefore, the insertion work is easier and the workability is higher than in a configuration in which the guide pins 75L and 75R are inserted into the guide holes 430L and 430R at the same time.

In the present embodiment, when the adapter body 700 of the adapter 7 separates from the upper frame 31, the left-and-right guide pins 75L and 75R remain inserted into the left-and-right guide holes 430L and 430R, respectively. That is, the lengths of the one pair of left-and-right guide pins 75L and 75R are set such that, with the left-and-right guide pins 75L and 75R inserted into the left-and-right guide holes 430L and 430R, the adapter body 700 of the adapter 7 separates upward from the one pair of left-and-right vertical plates 43L and 43R of the center section 4 as viewed from the left-and-right direction. Therefore, it is possible to inhibit the load swing of the adapter 7 resulting from the adapter 7 moving away from the upper frame 31 and prevent the adapter 7 from coming into contact with a tank or guard disposed nearby. Note that in the above, when the adapter 7 separates from the upper frame 31, the state in which one of the left-and-right guide pins 75L and 75R is inserted into the corresponding guide hole of the left-and-right guide holes 430L and 430R may be maintained.

According to the present embodiment, the left side guide part 431L is disposed between the tilt deck 81 on which a cabin (not shown) is installed and the hydraulic oil tank 83 in the front-and-rear direction. Therefore, the operator can reliably visually recognize the insertion situation of at least the left side guide pin 75L into the guide hole 430L of the left side guide part 431L from the side of the machine.

The boom mount device of a construction machine according to the present invention is not limited to the embodiment described above, and various modifications and improvements can be made as illustrated below.

For example, the embodiment described above has illustrated the case where the left-and-right brackets 450L and 450R are provided on the left-and-right back plates 45L and 45R, but the boom mount device is not limited to this example, and may have an aspect in which the left-and-right brackets 450L and 450R are provided directly on the upper edge of the left-and-right vertical plates 43L and 43R.

The embodiment described above has illustrated the configuration in which the left-and-right guide holes 430L and 430R are disposed at substantially the same height, and the left side guide pin 75L is longer and protrudes more downward than the right side guide pin 75R, but the present invention is not limited to this configuration.

For example, the present invention may have a configuration in which the left-and-right guide pins 75L and 75R have substantially the same length, and the left side guide hole 430L is disposed at a position higher than the right side guide hole 430R. Also in such a modified embodiment, the guide pin 75L can be inserted into the guide hole 430L first, and then the opposite side guide pin 75R can be inserted into the guide hole 430R.

The embodiment described above has illustrated the case where, when the adapter 7 separates from the upper frame 31, the left-and-right guide pins 75L and 75R remain inserted into the left-and-right guide holes 430L and 430R, respectively, but the present invention is not limited to this case.

For example, when the adapter 7 separates from the upper frame 31, one of the left-and-right guide pins 75L and 75R may be remain inserted into one of the left-and-right guide holes 430L and 430R. That is, the present invention may have a configuration in which, when the adapter 7 separates from the upper frame 31, one of the left-and-right guide pins 75L and 75R has a length to remain inserted into one of the left-and-right guide holes 430L and 430R.

As described above, the boom mount device of a construction machine according to the present invention is suitable for attaching the boom to the upper frame in the hydraulic excavator or the like.

The present invention provides a boom mount device for mounting a boom on an upper frame in a construction machine including the upper frame, the boom supported by the upper frame to allow rising and falling, and a boom rising and falling cylinder that expands and contracts to cause the boom to rise and fall. The boom mount device includes: a center section provided on the upper frame and including a bottom plate and one pair of left-and-right vertical plates erected on the bottom plate; and an adapter that pivotably connects each of the boom and the boom cylinder to the center section. The adapter includes: an adapter body that pivotably supports a base end of the boom and a base end of the boom cylinder around rotation central axes each extending in a left-and-right direction; and one pair of left-and-right guide pins each extending downward from the adapter body, the one pair of left-and-right vertical plates each includes: an outside surface facing outside of the left-and-right direction; and a guide part disposed on the outside surface and including an upper surface part, a guide hole capable of receiving each of the guide pins along a downward direction when the boom is attached to the upper frame being open on the upper surface part of the guide part.

With such a configuration, the guide part is disposed on each of the surfaces facing outside of the one pair of left-and-right vertical plates constituting the center section, and the adapter is provided with the one pair of left-and-right guide pins. Therefore, when mounting the adapter on the center section, an operator can visually recognize the insertion situation of the left-and-right guide pins and the guide holes of the left-and-right guide parts from the side of the machine. When the left-and-right guide pins are inserted into the left-and-right guide holes, the adapter supporting the boom can be positioned in the front-and-rear direction and the left-and-right direction with respect to the center section. Therefore, when mounting the boom on the upper frame of a construction machine, it is possible to align both in a horizontal direction.

In the configuration described above, preferably, the adapter body of the adapter includes: one pair of left-and-right rearward overhang parts that overhangs rearward of the machine, the one pair of left-and-right rearward overhang parts including overhang part outside surfaces each facing outside of the left-and-right direction; and one pair of left-and-right engagement pins extending outside of the left-and-right direction from the overhang part outside surfaces of the one pair of left-and-right rearward overhang parts, and the center section includes one pair of left-and-right positioning parts each including: one pair of front-and-rear inner wall surfaces disposed to face each other in a front-and-rear direction to define a recess opened upward; and a lower surface part connecting the one pair of inner wall surfaces, the one pair of left-and-right positioning parts preventing the adapter from at least moving downward by receiving the one pair of left-and-right engagement pins of the adapter body into the recess from above when the boom is attached to the upper frame.

With this configuration, when the left-and-right engagement pins fit into the recesses of the left-and-right positioning parts, the adapter supporting the boom can be positioned in the downward direction with respect to the center section. At this time, since the left-and-right engagement pins protrude outside from the outside surfaces of the left-and-right rearward overhang parts, the engagement pins are easily visually recognized by the operator. Therefore, when mounting the boom on the upper frame of a construction machine, it is possible to align both in an up-and-down direction.

In the configuration described above, preferably, positioning pin holes penetrating the rearward overhang parts along the left-and-right direction are opened in the one pair of left-and-right rearward overhang parts, and the adapter body further includes a positioning pin having a dimension larger than a space between the one pair of left-and-right rearward overhang parts in the left-and-right direction, the positioning pin is fixed to the one pair of left-and-right rearward overhang parts while both ends of the positioning pin are inserted into the one pair of left-and-right positioning pin holes such that the both ends protrude outside of the left-and-right direction from the one pair of left-and-right rearward overhang parts, and the both ends of the positioning pin constitute the one pair of left-and-right engagement pins.

With this configuration, since both ends of the one positioning pin can constitute the one pair of engagement pins, relative positions of the one pair of engagement pins can be stably maintained. The positioning pin connects the left-and-right rearward overhang parts to each other, and can enhance rigidity of the adapter body.

In the configuration described above, preferably, when the boom is attached to the upper frame, relative positions of the one pair of left-and-right guide pins and the guide parts of the one pair of left-and-right vertical plates are set such that a first guide pin of the one pair of left-and-right guide pins is inserted into one of the guide holes of the one pair of left-and-right vertical plates before a second guide pin.

With this configuration, the insertion work is easier and the workability is higher than in a configuration in which the one pair of left-and-right guide pins is inserted into the one pair of left-and-right guide holes at the same time.

In the configuration described above, preferably, lengths of the one pair of left-and-right guide pins are set such that, in a case where the adapter is detached from the upper frame, when a lower end of the adapter body agrees with an upper end of the one pair of left-and-right vertical plates of the center section as viewed from the left-and-right direction, at least one of the one pair of left-and-right guide pins is inserted into at least one of the guide holes of the one pair of left-and-right vertical plates.

With this configuration, it is possible to inhibit the load swing of the adapter when the adapter moves away from the upper frame and prevent the adapter from coming into contact with a tank or guard disposed nearby.

In the configuration described above, preferably, at least one of the one pair of left-and-right guide parts is disposed at a position visually recognizable from outside of the construction machine in side view.

With this configuration, the operator can reliably visually recognize from the side of the machine how at least one of the guide pins is inserted into the guide hole of the guide part.

The invention claimed is:

1. A boom mount device of a construction machine for mounting a boom on an upper frame in the construction machine including the upper frame, the boom supported by the upper frame to allow rising and falling, and a boom cylinder that expands and contracts to cause the boom to rise and fall, the boom mount device comprising:

a center section provided on the upper frame and including a bottom plate and a pair of left-and-right vertical plates erected on the bottom plate; and an adapter that pivotably connects each of the boom and the boom cylinder in the center section, wherein the adapter includes:

an adapter body that pivotably supports a base end of the boom and a base end of the boom cylinder around rotation central axes each extending in a left-and-right direction and includes a pair of left-and-right side plates spaced from each other in the left-and-right direction, the pair of left-and-right side plates each having an inside surface facing the other side plate and an outside surface opposite to the inside surface; and a pair of left-and-right guide pins attached to the adapter body, and protruding from respective outside surfaces of the left-and-right side plates and extending a predetermined length downward from the adapter body, the pair of left-and-right vertical plates each includes:

an inside surface facing the other vertical plate;

an outside surface opposite to the inside surface; and a guide part attached to the outside surface of each of the pair of left-and-right vertical plates and including an upper surface part and a guide hole formed in the upper surface part for receiving the corresponding guide pin along a downward direction to guide attachment of the boom to the upper frame.

2. The boom mount device of a construction machine according to claim 1, wherein the adapter body of the adapter includes:

a pair of left-and-right rearward overhang parts that each overhang in a rearward of the machine, the pair of left-and-right rearward overhang parts including inside surfaces facing each other and outside surfaces opposite to the inside surfaces; and a pair of left-and-right engagement pins extending in the left-and-right directions from the respective outside surfaces of the pair of left-and-right rearward overhang parts, and the center section includes a pair of left-and-right positioning parts each including: a pair of front-and-rear inner wall surfaces facing each other in a front-and-rear direction to define a recess opened upward; and a lower surface part connecting the pair of inner wall surfaces, the pair of left-and-right positioning parts preventing the adapter from moving at least in a downward direction by receiving the pair of left-and-right engagement pins of the adapter body into the recess from above when the boom is attached to the upper frame.

3. The boom mount device of a construction machine according to claim 2, wherein the pair of left-and-right rearward overhang parts each includes a positioning pin hole penetrating through each of the pair of left-and-right rearward overhang parts in the left-and-right direction, and the adapter body further includes a positioning pin having a dimension larger than a space between the pair of left-and-right rearward overhang parts in the left-and-right direction, the positioning pin is fixed to the pair of left-and-right rearward overhang parts while both ends of the positioning pin are inserted into the pair of left-and-right positioning pin holes so that the both ends protrude from the respective outside surfaces of the pair of left-and-right rearward overhang parts, and the both ends of the positioning pin constitute the pair of left-and-right engagement pins.

4. The boom mount device of a construction machine according to claim 1, wherein when the boom is attached to the upper frame, relative the pair of left-and-right guide pins and the guide parts on the pair of left-and-right vertical plates are set in such positions that one of the pair of left-and-right guide pins comes into one of the pair of guide holes on the pair of left-and-right vertical plates before the other guide pin comes into the other guide hole.

5. The boom mount device of a construction machine according to claim 1, wherein the pair of left-and-right guide pins are set in such lengths that, when a lower end of the adapter body agrees with a level of an upper end of the pair of left-and-right vertical plates in the center section from in view of the left-and-right direction in a process of detaching the adapter from the upper frame, at least one of the pair of left-and-right guide pins is in the corresponding one of the guide holes on the pair of left-and-right vertical plates.

6. The boom mount device of a construction machine according to claim 1, wherein at least one of the pair of left-and-right guide parts is disposed at such a position that an operator can see the at least one of the pair of left-and-right guide parts from outside of the construction machine in a side view.

* * * * *